United States Patent [19]

Zaniewski

[11] 4,342,258

[45] Aug. 3, 1982

[54] VENTILATOR

[76] Inventor: Michel H. Zaniewski, Avenue Ferdinand de Lesseps, 34110 Frontignan, France

[21] Appl. No.: 159,653

[22] Filed: Jun. 16, 1980

[30] Foreign Application Priority Data

Jun. 18, 1979 [FR] France ..... 79 16182

[51] Int. Cl.[3] ..... F23L 17/02

[52] U.S. Cl. ..... 98/78; 98/75; 98/83

[58] Field of Search ..... 98/20, 22, 42 R, 43, 98/58, 60, 69, 70, 72, 75, 78, 84, 83; 110/160, 162

[56] References Cited

U.S. PATENT DOCUMENTS

| | | | |
|---|---|---|---|
| 1,348,513 | 8/1920 | Morey | 98/72 |
| 2,824,507 | 2/1958 | Alldritt | 98/43 R |
| 3,347,147 | 10/1967 | Howard | 98/78 |
| 4,200,035 | 4/1980 | Zaniewski | 98/43 R |

FOREIGN PATENT DOCUMENTS

| | | | |
|---|---|---|---|
| 157993 | 8/1954 | Australia | 98/43 R |
| 409960 | 3/1945 | France | 98/78 |

*Primary Examiner*—Albert J. Makay
*Assistant Examiner*—Harold Joyce
*Attorney, Agent, or Firm*—Karl F. Ross

[57] ABSTRACT

A ventilator for use on a conduit having an upwardly open mouth has a generally toroidal annular flow body surrounding the conduit immediately below the mouth thereof. This body has an outer wall having an outwardly convex lower portion spaced outwardly from the conduit and an upper portion extending generally asymptotically upward and inwardly from the lower portion to the conduit and joining the conduit substantially at the mouth. Air flow is induced over the body to create a low-pressure zone at the mouth by providing a horizontal deflector disk suspended above the mouth and having an outer periphery extending outwardly beyond the mouth so as to define with this mouth an annular gap having a flow cross section greater than that of the mouth. The disk may be combined with a fan that generates a downwardly flaring air stream that moves downwardly around the periphery of the disk and across the gap.

6 Claims, 7 Drawing Figures

VENTILATOR

FIELD OF THE INVENTION

The present invention relates to a ventilator. More particularly this invention concerns a ventilator of the type that is normally mounted on top of a conduit to enhance flow upwardly out of the conduit.

BACKGROUND OF THE INVENTION

It is known to provide ventilators at the upper ends of conduits in order to enhance the vertical flow through them. Such ventilators can be employed for enhancing the draft in a flue from a fireplace or furnace, or for enhancing the flow in a ventilating conduit. In some ventilating systems it is desired to place the suction fan at the upper end of the exhaust conduit to remove it as far as possible from the location where the air is being drawn from, so as to minimize noise. Furthermore it is frequently desired to enhance the draw at the outlet end of a conduit in order to prevent leakage out of the conduit, as in an installation for exhausting noxious fumes or industrial gases.

The simplest type of such a ventilator is a so-called static ventilator which is so constituted as to employ normally present air currents to enhance the draft from the upwardly open conduit mouth. This can most simply be done by mounting a flat plate above the upper mouth of the conduit so that as air passes horizontally between the plate and the conduit mouth gases are sucked from the conduit by the Pitot effect. Such a system is almost completely ineffective when the draft past the conduit mouth is not horizontal, and can indeed allow outside air to blow back down the stack.

Dynamic ventilators are known, such as described in my copending application Ser. No. 869,222 filed Jan. 13, 1978 (now U.S. Pat. No. 4,200,035). These arrangements have a fan provided at the upper end of the conduit mouth and serving physically to suck air out of the conduit. Such arrangements are extremely effective, yet have several disadvantages. Mainly the disadvantage of these systems is that the air rising out of the conduit passes over the blades of the fan and normally also over the drive motor for the fan, thereby heating it considerably. As a result the service life of such a system, in particular in arrangements where corrosive vapors or the like are carried on the air rising from the conduit, is relatively short. Furthermore when the air rising from the conduit is quite hot this heat is transmitted to the fan and to the motor so that, once again, their service life is considerably reduced.

OBJECTS OF THE INVENTION

It is therefore an object of the present invention to provide an improved ventilator.

Another object is to provide a ventilator of the static and/or dynamic type which overcomes the above-given disadvantages.

SUMMARY OF THE INVENTION

These objects are attained according to the instant invention in a ventilator having a generally toroidal annular flow body which surrounds the conduit immediately below its upwardly open mouth. This flow body has an outer wall having in turn a lower portion spaced outwardly from the conduit and an upper portion extending generally asymptotically upwardly and inwardly from the lower portion to the conduit and joining the conduit substantially at its mouth. Means is provided above this body for inducing air flow downwardly over the body and thereby creating a low-pressure zone at the mouth of the conduit.

This means normally induces a downward current of air that is deflected outwardly by the flow body so that gases within the conduit are literally sucked from it.

According to this invention the means includes a horizontal deflector disk suspended above the mouth and having an outer periphery extending outwardly slightly past the mouth. This disk defines with the mouth an annular gap having a flow cross section greater than that of the mouth and is domed and upwardly convex inwardly of its periphery. Thus this disk not only prevents rain and the like from entering the upwardly open mouth of the conduit, but ensures that any currents of air around the conduit will be deflected in such a manner as to induce air flow over the body and thereby create a low-pressure zone at the mouth of the conduit.

According to another feature of this invention the means includes a fan above the disk for generating an air stream that moves downwardly around the periphery of the disk and across the gap. This fan is constituted as an axial throughput impeller rotated about an upright axis by a drive motor fixed above the body, and having a sleeve closely radially surrounding the impeller and centered on its rotation axis. Thus the fan forms a downwardly moving column of air that is deflected outwardly by the outwardly convex lower portion of the flow body so as to create the above-described outwardly flaring annular column of air that effectively sucks gas from within the conduit. According to this invention a domed cover is spacedly fixed above the sleeve to protect the fan.

It is possible according to this invention to mount the disk on the fan, and even to provide the underside of the disk with generally radially extending semicylindrical vanes that throw air radially outwardly and greatly enhance the effectiveness of the system. In this arrangement the disk is mounted via a thermal dam on the impeller, and may even be provided with a downwardly extending squirrel-cage fan, that is a fan of the axial-input radial-output type, so as further to enhance draw from the conduit. The blades of the impeller according to this invention have trailing edges provided with bent-out lips for radial outward deflection of the air stream created by it so as further to enhance draw from the conduit.

In an arrangement wherein several flues terminate immediately adjacent each other in a common chimney, the conduit according to this invention has a lower part connected to the flue, a slanted intermediate part, and an upright upper part offset from the lower part so that several such ventilators according to this invention can be mounted on immediately adjacent flues without in any way interfering with each other.

In order to ease servicing of the arrangement according to this invention the disk described above is mounted via at least two struts on the conduit. The disk can be disattached from one of the struts and pivoted about the other strut so as to completely free the upper end of the conduit and allow it to be cleaned.

Thus according to this invention the disk, which operates primarily statically, converts virtually any type of air current into an air current capable of inducing a low-pressure zone at the conduit mouth. The dynamic elements of the invention are constituted further to increase the draft, but are so made up that they normally lie wholly outside of the path of gases exiting from the conduit. Thus the system according to the instant invention will have a relatively long service life.

SPECIFIC DESCRIPTION

Figure 1:
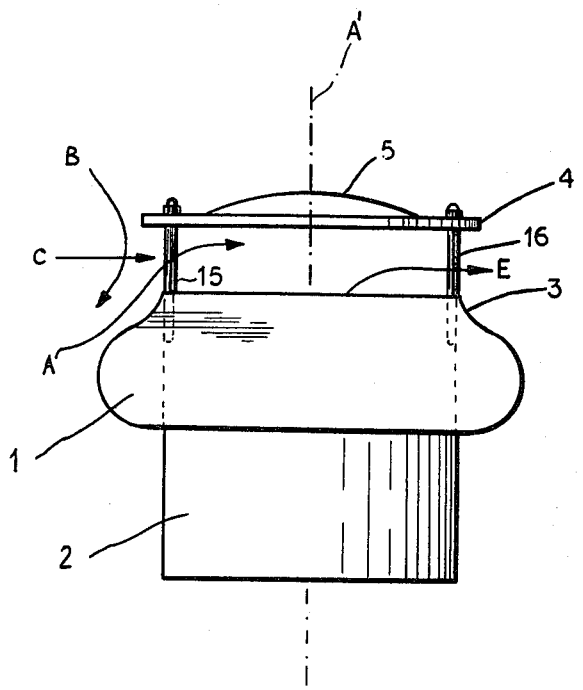
FIG. 1 is a side view of a simple embodiment of the system according to this invention.

As shown in FIG. 1 a cylindrical conduit 2 is centered on an axis A and provided with a flow body 1 that is basically outwardly convex and provided with an upper portion 3 that asymptotically approaches the open upper mouth of the conduit 2. Struts 15 and 16 support a disk 4 above the mouth of the conduit 2, this disk 4 being formed with a central part-spherical dome 5.

With the system according to the instant invention horizontal air currents such as shown at C will pass between the disk 4 and the mouth 3 of the conduit and will induce flow from it as shown by arrow E. Rising air currents such as shown at A will be deflected upwardly and between the disk 4 and the mouth of the conduit 2 so as similarly to enhance flow. Finally a falling current such as shown at B will similarly be deflected outwardly and downwardly so as to form in effect a downwardly flared skirt of air that creates a low-pressure zone underneath the disk 4. This disk 4 has a diameter that is slightly greater than that of the mouth of the conduit 2, but is spaced far enough above the mouth of the conduit 2 that the gap formed between it and the conduit 2 is considerably greater in flow cross section than the flow cross section of the conduit 2.

Figure 2:
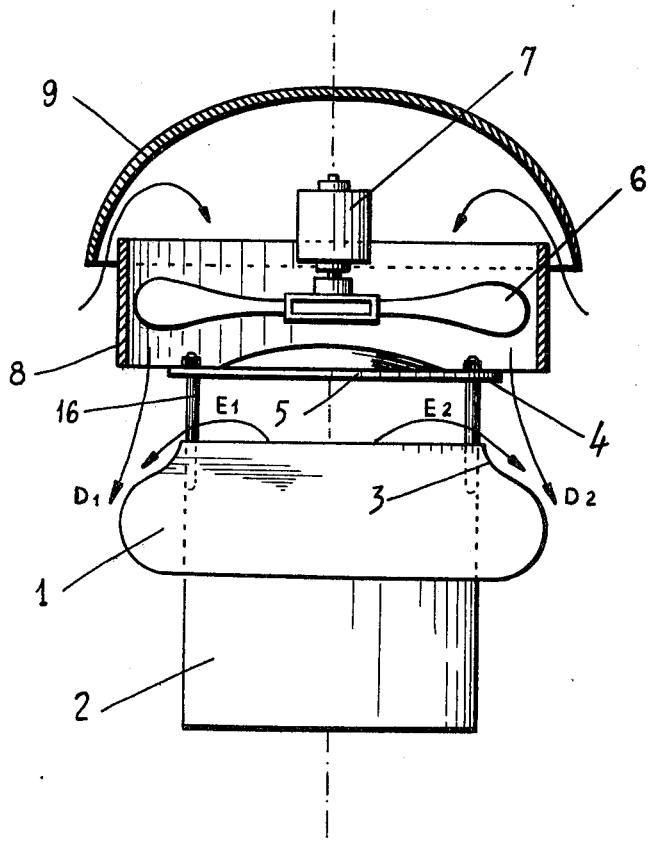
FIG. 2 is a side partly sectional view of the system of FIG. 1 with a dynamic ventilating arrangement attached to it.

It is possible as shown in FIG. 2 to provide an axial-throughput impeller 6 mounted on a motor 7 in a cylindrical sleeve 8 above the disk 4. A domed cover 9 is provided above and protects the motor 7. The motor 7, cover 9, and sleeve 6 are all fixed relative to each other and to the body 1.

When the motor 7 rotates the impeller 6 it draws air in through the gap between the outer periphery of the domed cover 9 and the upper edge of the sleeve 8, and forces it downwardly around the disk 4, as the diameter of the fan 6 is considerably greater than that of the disk 4, but slightly smaller than the maximum diameter of the body 1. This creates air currents such as shown at $D_1$ and $D_2$, which in turn serve to suck air out of the conduit 2 as shown at $E_1$ and $E_2$, respectively. This jet-action effect not only ensures excellent drawing out of the conduit 2, but also ensures cooling of the disk 4 so that in the event the gases rising from the conduit 2 are very hot this disk 4 will not be overheated and damaged. At the same time the air flowing through all the parts above the disk 4 is merely ambient air, it is not the air rising from the conduit 2. Even if the gases rising from the conduit 2 include, for example, noxious or acidic vapors, the fan impeller 6 will not be harmed.

Figure 3:
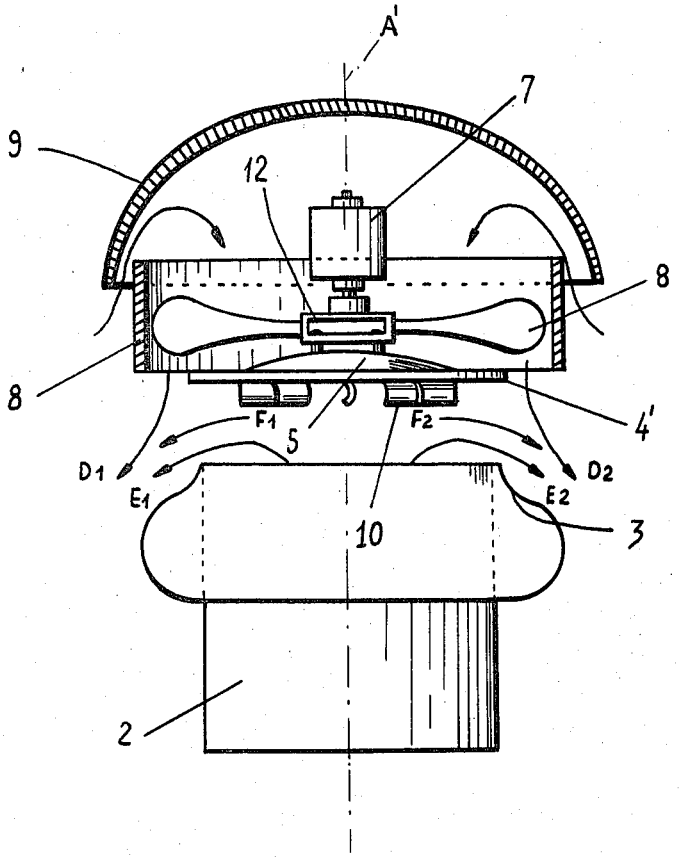
FIG. 3 is a view similar to FIG. 2 but showing an alternative arrangement according to this invention.

FIG. 3 shows how a disk 4' identical to the disk 4 is mounted via a laterally open thermal dam 12 on the fan 6, and is provided on its lower surface with semicylindrical and radially extending vanes 10 all angularly equispaced about the axis A'. These vanes 10 therefore rotate with the fan 6 and ensure radial outward flow as indicated at arrows $F_1$ and $F_2$, thereby further enhancing draw from the conduit 2.

Figure 4:
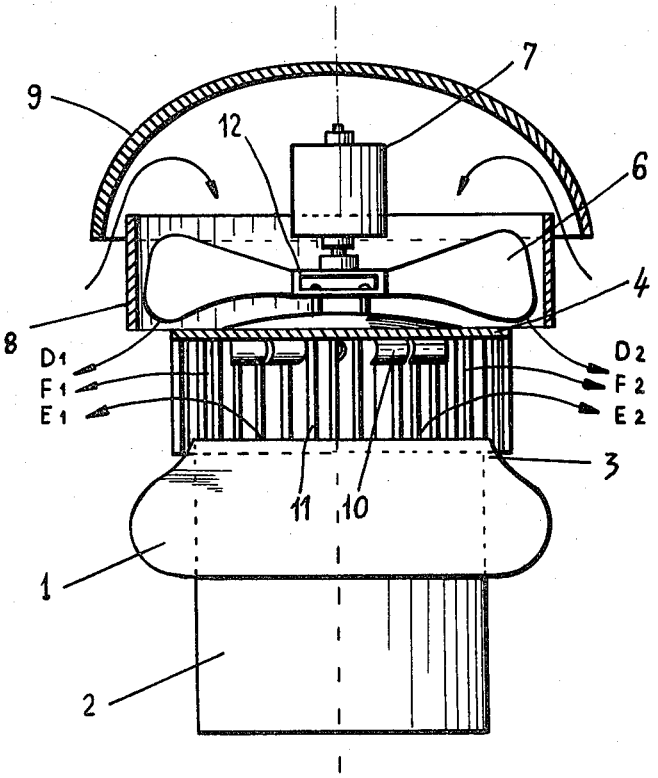
FIG. 4 is a view similar to FIG. 3 and showing the arrangement of FIG. 3 with another element added.

Draw can be even further enhanced by providing as shown in FIG. 4 a squirrel-cage or axial-input radial-output impeller 10 on the bottom of the disk 4. This impeller 10 has a diameter slightly greater than that of the upper end of the conduit 2 and extends axially downwardly slightly past it so as to ensure excellent flow from the conduit 2.

Figure 5:
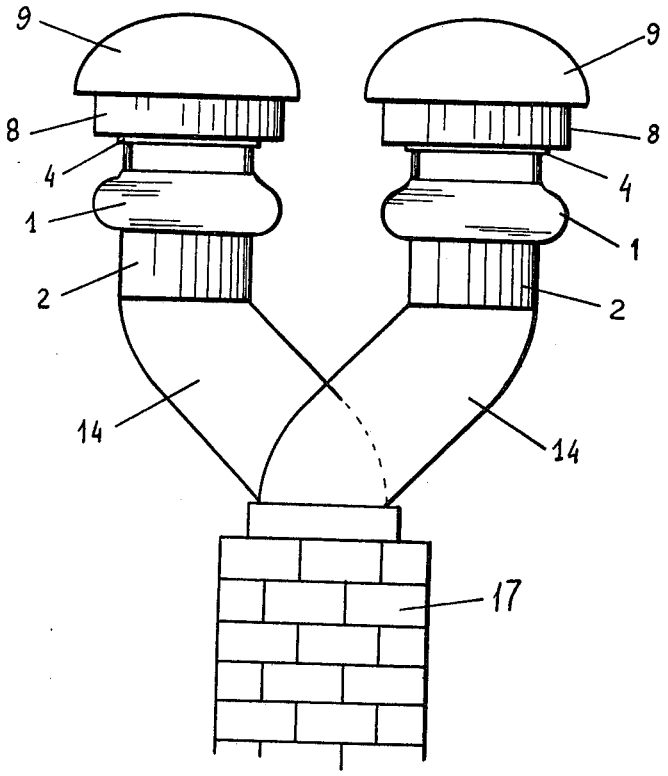
FIG. 5 is a side view of a multiple-flue arrangement according to this invention.

In FIG. 5 a chimney 17 is shown having two flue extensions 14 that have lower parts that lie immediately adjacent each other, intermediate parts that are angled, and upper parts that form the conduits 2. Such an arrangement allows two assemblies according to the invention to be mounted on flues that are immediately adjacent each other, without the assemblies interfering with one another.

Figure 6:
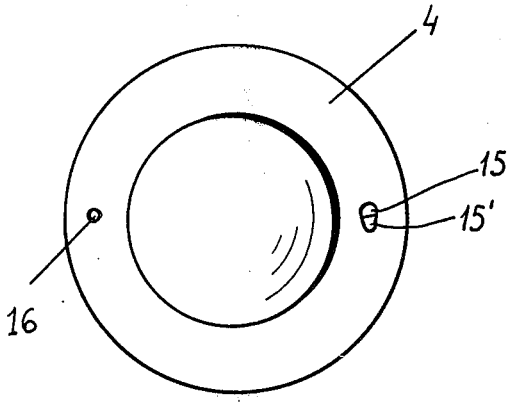
FIG. 6 is a top view of a detail of the arrangement of FIG. 1.

FIG. 6 shows how the one strut 16 is secured at a round hole and the other strut 15 is secured at a keyhole-shaped slot 15'. In order to service the conduit, as to clean it, one need merely loosen the nuts at the top ends of the struts 15 and 16, then lift the side of the disk 4 having the slot 15' off the strut 15 and pivot it around the strut 16, thereby moving it laterally completely out of the way of the upper open end of the conduit 2.

Figure 7:
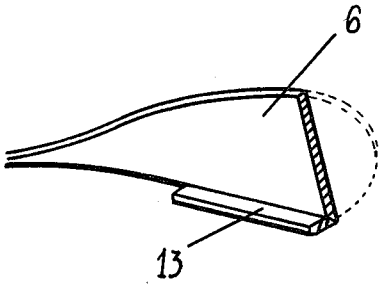
FIG. 7 is a partly sectional large-scale perspective view of a detail of the arrangement of FIG. 4.

Finally FIG. 7 shows how a vane of the impeller 6 can have a bent-out lip 13 that will deflect the air stream created by this fan 6 radially outwardly somewhat, so that the fan 6 does not operate exclusively as an axial-throughput fan. In this manner a downwardly flaring frustocone of air is created around the body 1 so as to enhance the draft-increasing effect thereof.

I claim:

1. A ventilator for use in combination with a conduit having an upwardly open mouth of predetermined shape and flow cross section, said ventilator comprising:

a generally toroidal annular flow body surrounding said conduit immediately below said mouth and having an outer wall having a lower portion spaced outwardly from said conduit and an outwardly concave and curved upper portion extending upward and inward from said lower portion to said conduit and merging with said conduit substantially at said mouth; and means including a horizontal deflector disk suspended above said mouth and fixed adjacent said body, said disk having an outer periphery extending outwardly beyond said mouth and defining with said mouth an annular gap having a flow cross section greater than that of said mouth, and a fan including a drive motor fixed above said disk, an axial-throughput impeller rotatable about an upright axis by said drive motor and extending radially horizontally beyond said disk, a sleeve closely surrounding said impeller and centered on said axis, and a cover spacedly fixed above said sleeve for generating an air stream that moves downwardly around said periphery of said disk and across said gap for inducing air flow over said body and thereby creating a low-pressure zone at said mouth.

2. The ventilator defined in claim 1 wherein said disk is fixed underneath said impeller and has an underside provided with a plurality of radially extending vanes.

3. The ventilator defined in claim 2 wherein said disk is provided with a squirrel-cage fan impeller on said underside and surrounding said mouth.

4. The ventilator defined in claim 2 wherein said vanes are generally semicylindrical.

5. The ventilator defined in claim 2, further comprising a thermal dam between said disk and said impeller.

6. The ventilator defined in claim 2 wherein said impeller has blades with leading and trailing edges relative to its normal direction of rotation about said axis, said trailing edges having bent-out lips for radial outward deflection of said air stream.

* * * * *